US010974319B2

(12) United States Patent
Kaneko et al.

(10) Patent No.: US 10,974,319 B2
(45) Date of Patent: Apr. 13, 2021

(54) CASTING DEVICE

(71) Applicant: MITSUBISHI HEAVY INDUSTRIES, LTD., Tokyo (JP)

(72) Inventors: Takeshi Kaneko, Tokyo (JP); Masaki Taneike, Tokyo (JP); Hidetaka Oguma, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 211 days.

(21) Appl. No.: 16/082,724

(22) PCT Filed: Mar. 9, 2017

(86) PCT No.: PCT/JP2017/009475
§ 371 (c)(1),
(2) Date: Sep. 6, 2018

(87) PCT Pub. No.: WO2017/155037
PCT Pub. Date: Sep. 14, 2017

(65) Prior Publication Data

US 2019/0076919 A1 Mar. 14, 2019

(30) Foreign Application Priority Data

Mar. 11, 2016 (JP) ..... JP2016-047733

(51) Int. Cl.
*B22D 27/04* (2006.01)
*B22D 30/00* (2006.01)
(Continued)

(52) U.S. Cl.
CPC ..... *B22D 27/04* (2013.01); *B22C 9/04* (2013.01); *B22C 9/065* (2013.01); *B22C 9/10* (2013.01);
(Continued)

(58) Field of Classification Search
CPC .. B22C 9/04; B22C 9/06; B22C 9/065; B22C 9/10; B22C 9/22; B22C 9/24;
(Continued)

(56) References Cited

U.S. PATENT DOCUMENTS 5,921,310 A 7/1999 Kats et al.
6,868,893 B2 * 3/2005 Shimohata et al. . B22D 27/045 164/122.1
(Continued)

FOREIGN PATENT DOCUMENTS

JP 3919256 2/2007

OTHER PUBLICATIONS

International Search Report dated Apr. 11, 2017 in International (PCT) Application No. PCT/JP2017/009475.

*Primary Examiner* — Kevin P Kerns
(74) *Attorney, Agent, or Firm* — Wenderoth, Lind & Ponack, L.L.P.

(57) ABSTRACT

In a casting device, positions of discharge ends discharging cooling gas, of respective gas supply nozzles are adjusted in response to movement of a mold. This makes it possible to stably achieve high cooling performance for the mold by blowing of the cooling gas. To adjust the positions of the respective discharge ends, the gas supply nozzles are advanced or retreated, or are expanded or contracted. Further, a cooling chamber may include a radiation cooling portion that cools the mold by radiation, and the radiation cooling portion is disposed below the gas supply nozzles that are provided directly below a heat shielding body partitioning a heating chamber and the cooling chamber.

16 Claims, 8 Drawing Sheets

(51) Int. Cl.

| | |
|---|---|
| ***B22C 9/22*** | (2006.01) |
| ***B22D 27/00*** | (2006.01) |
| ***B22C 9/06*** | (2006.01) |
| ***B22C 9/10*** | (2006.01) |
| ***B22C 9/04*** | (2006.01) |
| ***B22C 9/24*** | (2006.01) |

(52) U.S. Cl.
CPC ..... *B22C 9/106* (2013.01); *B22C 9/22* (2013.01); *B22C 9/24* (2013.01); *B22D 27/003* (2013.01); *B22D 30/00* (2013.01)

(58) Field of Classification Search
CPC ..... B22D 27/00; B22D 27/003; B22D 27/04; B22D 27/045; B22D 30/00
USPC ..... 164/122, 122.1, 122.2, 124, 125, 126, 164/128, 338.1, 348
See application file for complete search history.

(56) References Cited

U.S. PATENT DOCUMENTS

| | | | | |
|---|---|---|---|---|
| 7,017,646 | B2 * | 3/2006 | Balliel et al. ..... | B22D 27/045 164/122.1 |
| 10,082,032 | B2 * | 9/2018 | Naik ..... | B22D 27/045 |

* cited by examiner

FIG. 8A
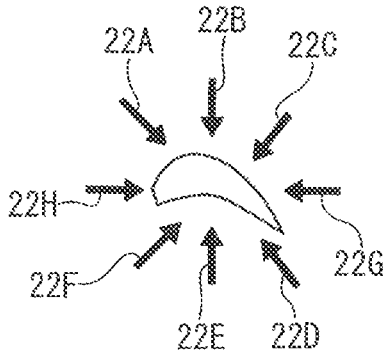
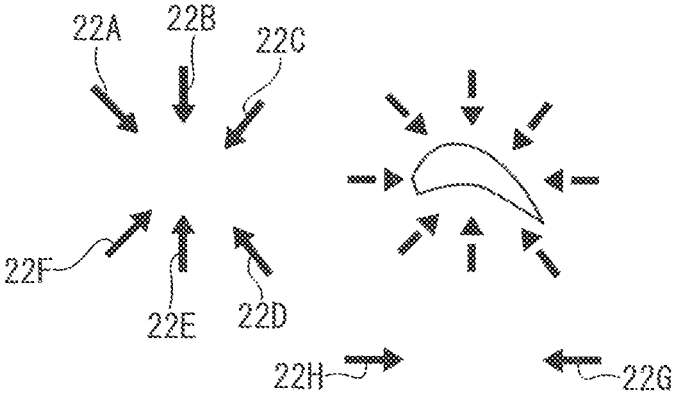
FIG. 8B
FIG. 8C
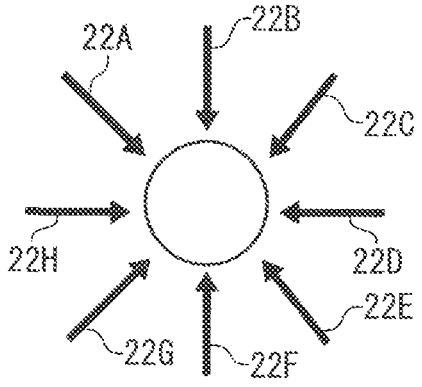
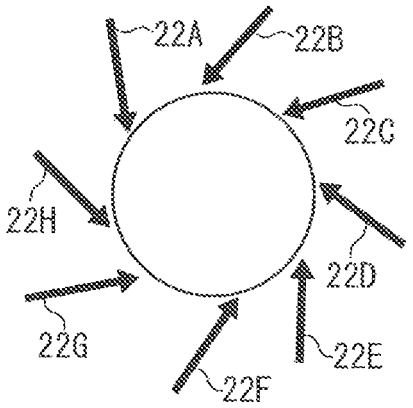
FIG. 8D

CASTING DEVICE

TECHNICAL FIELD

The present invention relates to a casting device that produces a casting through directional solidification, and in particular to a casting device high in cooling performance for the directional solidification.

BACKGROUND ART

For example, in a turbine blade and other components, the suppression of creep deformation and the improvement of fatigue strength have been sought by using precision casting by means of directional solidification to make the crystal structure columnar crystalline or single crystalline. The casting device sequentially cools a mold poured with a molten metal from one end part toward the other end, normally from a lower end part toward an upper end part, thereby achieving the directional solidification. The casting device includes a heating chamber and a cooling chamber that are adjacent to each other, and the mold poured with the molten metal in the heating chamber is moved, from the lower end part, to the cooling chamber at a slow speed.

As described above, to achieve the directional solidification, the mold is moved to the cooling chamber at a slow speed and solidification advances while maintaining a state where temperature gradient at a solidification interface of the molten metal is large. To reduce casting defect and to obtain a sound columnar crystal or a sound single crystal, it is important to increase the temperature gradient to accelerate solidification (or cooling).

As means to accelerate the solidification, cooling gas containing inert gas is blown to the mold in the cooling chamber, for example, as disclosed in JP3919256 B2.

SUMMARY OF INVENTION

An object of the present invention is to stably achieve high cooling performance in the casting device in which cooling gas is blown to the mold in the cooling chamber.

A casting device according to the present invention includes a heating chamber in which a molten metal is poured into a mold, and a cooling chamber that is provided adjacently to the heating chamber and in which directional solidification is effected while the mold poured with the molten metal is moved.

The cooling chamber according to the present invention includes a gas cooling portion that includes one or more gas supply nozzles each blowing cooling gas toward the mold, and positions of discharge ends discharging the cooling gas of the respective gas supply nozzles are adjusted in response to movement of the mold.

In the casting device according to the present invention, the positions of the discharge ends discharging the cooling gas of the respective gas supply nozzles are adjusted in response to movement of the mold. This makes it possible to keep a distance between each of the discharge ends and the mold constant, and to accordingly stably achieve high cooling performance by blowing of the cooling gas. Alternatively, the distance is adjustable to an appropriate distance irrespective of whether the distance between each of the discharge ends and the mold is kept constant. This makes it possible to further stably achieve high cooling performance by blowing of the cooling gas.

The one or more gas supply nozzles according to the present invention may be moved to adjust the positions of the respective discharge ends. As one mode, the one or more gas supply nozzles may be advanced or retreated to adjust the positions of the respective discharge ends. In addition, in the present invention, the one or more gas supply nozzles may be expanded or contracted at fixed positions to adjust the positions of the respective discharge ends.

In the present invention, the plurality of gas supply nozzles are preferably radially provided in a horizontal direction to surround the mold.

In the present invention, the gas supply nozzles may each include a slit-like nozzle opening extending in a horizontal direction.

In the present invention, the discharge ends of the gas supply nozzles may be directed downward.

The cooling chamber according to the present invention preferably includes a radiation cooling portion configured to cool the mold by radiation.

The radiation cooling portion according to the present invention is preferably arranged, below the gas cooling portion that is provided directly below a heat shielding body partitioning the heating chamber and the cooling chamber, in series to the gas cooling portion in a vertical direction.

The radiation cooling portion preferably includes a cylindrical water-cooling jacket that surrounds the mold below the gas cooling portion and through which cooling water circulates.

In the present invention, in a case where casting is performed in a plurality of molds at the same time, one or more gas supply nozzles associated with the molds are provided. In this case, the positions of the discharge ends of the one or more gas supply nozzles are adjustable in response to movement of the molds.

In the casting device, the one or more gas supply nozzles may be rotated in a horizontal direction to adjust the positions of the respective discharge ends.

Advantageous Effects of Invention

According to the casting device of the present invention, the positions of the discharge ends discharging the cooling gas of the respective gas supply nozzles are adjusted in response to movement of the mold. This makes it possible to stably achieve high mold cooling performance by blowing of the cooling gas.

BRIEF DESCRIPTION OF DRAWINGS

FIGS. 8A-8D are diagrams each illustrating another moving state of the nozzle that discharges the cooling gas used in the present embodiment.

DESCRIPTION OF EMBODIMENT

A casting device 1 according to an embodiment of the present invention is described below with reference to accompanying drawings.

The casting device 1 fabricates, for example, gas turbine components such as a rotor blade and a vane that are required to have mechanical strength at high temperature, through precision casting to which directional solidification is applied. In particular, the casting device 1 is designed to maximize mold cooling performance by cooling gas.

Figure 1:
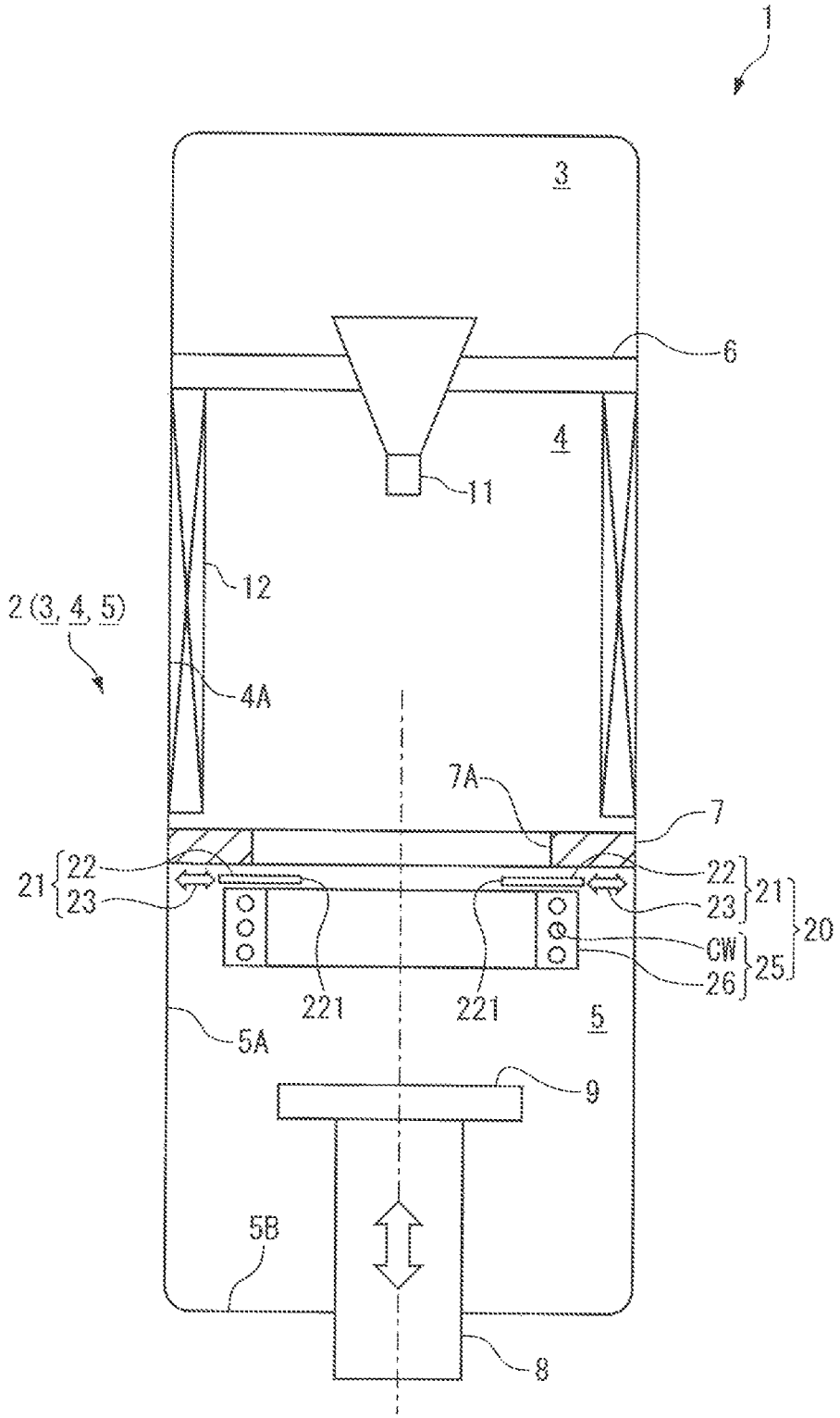
FIG. 1 is a cross-sectional view illustrating a schematic configuration of a casting device according to an embodiment of the present invention.

As illustrated in FIG. 1, the casting device 1 includes a vacuum chamber 2 in which an internal space is held in a depressurized state, a pouring chamber 3 that is disposed at a relatively upper part inside the vacuum chamber 2, a heating chamber 4 that is provided below the pouring chamber 3 inside the vacuum chamber 2, and a cooling chamber 5 that is disposed below the heating chamber 4 inside the vacuum chamber 2. A heat shielding body 6 is provided at a boundary between the pouring chamber 3 and the heating chamber 4, and a heat shielding body 7 is provided at a boundary between the heating chamber 4 and the cooling chamber 5, inside the vacuum chamber 2.

Figure 2:
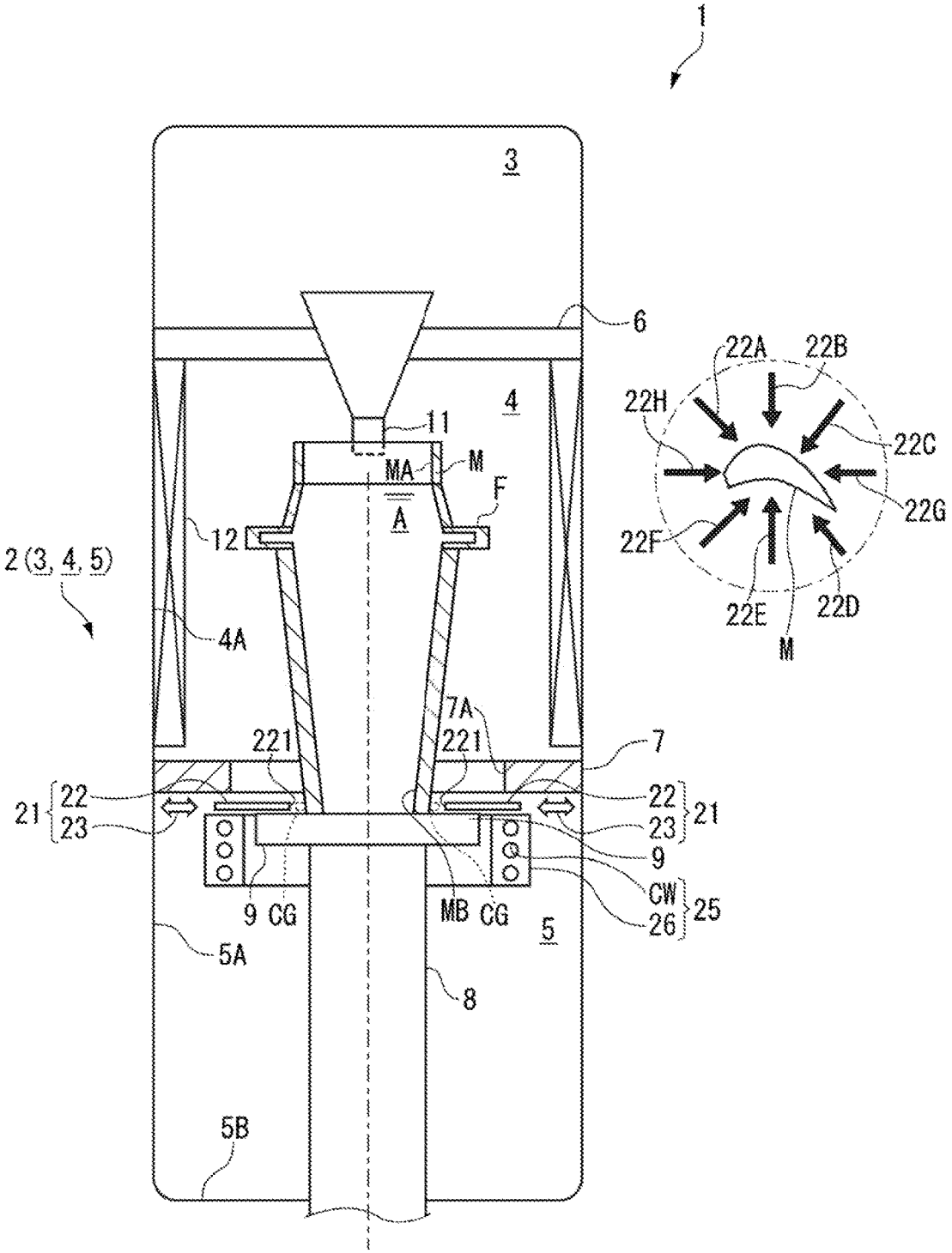
FIG. 2 is a diagram illustrating a state where a lower end part of a mold is moved to a cooling chamber in the casting device according to the present embodiment.

Further, FIG. 2 illustrates a state where a mold M is accommodated inside the casting device 1. As illustrated in FIG. 2, a driving rod 8 that elevates and lowers the mold M, and a cooling table 9 that is provided at a top of the driving rod 8 and supports and cools the mold M from below are provided inside the cooling chamber 5.

The mold M is made of a refractory material, and includes therein a cavity that is a space corresponding to an outer shape of, for example, a rotor blade or a vane to be cast, as illustrated in FIG. 2. In the mold M, a dimension of a lower end in a width direction (hereinafter, width dimension) is the smallest, and a width dimension of a flange F provided near an upper end is the largest.

The cavity of the mold M includes an upper opening MA at the upper end and a lower opening MB at the lower end, and penetrates through the mold M in a vertical direction. In addition, the cavity of the mold M can be filled with an alloy A in a molten state from the upper opening MA. In addition, the lower opening MB is closed by the cooling table 9 from below, and the cooling table 9 constitutes a bottom wall of the mold M.

In FIG. 1 and FIG. 2, the internal space of the vacuum chamber 2 is maintained in substantially a vacuum state by operation of a vacuum pump (not illustrated), in the casting.

In the pouring, in the pouring chamber 3, the alloy A in the molten state stored in a molten metal ladle (not illustrated), is poured into the mold M through a pouring nozzle 11. The pouring nozzle 11 is supported by the heat shielding body 6 that is the boundary between the pouring chamber 3 and the heating chamber 4. The molten metal ladle (not illustrated) is introduced into the pouring chamber 3 from outside before the vacuum chamber 2 is evacuated. Thereafter, after the vacuum chamber 2 is depressurized to vacuum, the alloy A in the molten state is poured from the molten metal ladle.

In the casting, the heating chamber 4 maintains the mold M poured with the alloy A in the molten state, at temperature higher than a melting point of the alloy A. To do so, as illustrated in FIG. 1 and FIG. 2, the heating chamber 4 includes a heater 12. The heater 12 is provided in a cylindrical shape along a circumferential direction of an inner wall surface 4A so as to surround the internal space of the heating chamber 4.

The heat shielding body 7 partitions the heating chamber 4 and the cooling chamber 5, and suppresses heat transfer therebetween.

As illustrated in FIG. 1 and FIG. 2, the heat shielding body 7 is provided so as to protrude from an inner wall surface 5A of the cooling chamber 5 toward a center in a horizontal direction, at the boundary between the heating chamber 4 and the cooling chamber 5. Further, the heat shielding body 7 includes, at a center part, a mold path 7A that allows the heating chamber 4 and the cooling chamber 5 to communicate with each other, and an opening diameter of the mold path 7A is set larger than the flange F having the maximum width dimension of the mold M. The mold M is disposed at a center part of the vacuum chamber 2, and is movable in the vertical direction between the heating chamber 4 and the cooling chamber 5 through the mold path 7A of the heat shielding body 7.

Next, the cooling chamber 5 is described.

The cooling chamber 5 is a region to solidify the poured alloy A in the molten state, and is maintained at temperature lower than the melting point of the alloy A poured in the mold M and includes a cooling mechanism 20 to forcibly cool the alloy A in the molten state.

The mold M that has received the alloy A in the molten state in the heating chamber 4 is moved to the cooling chamber 5. An upstream and a downstream are defined based on a direction in which the mold M is moved.

As illustrated in FIG. 1 and FIG. 2, the cooling mechanism 20 includes a gas cooling portion 21 and a radiation cooling portion 25.

The gas cooling portion 21 includes a plurality of gas supply nozzles 22 each jetting cooling gas CG (FIG. 2) supplied from gas supply source (not illustrated), and actuators 23 that respectively advance and retreat the gas supply nozzles 22. The gas supply nozzles 22 are moved in response to movement of the mold M, to adjust positions of discharge ends 221 of the respective gas supply nozzles 22.

The gas supply nozzles 22 are provided directly below the heat shielding body 7 as illustrated in FIG. 1 in a vertical direction, are radially provided along a horizontal direction so as to surround the mold M as illustrated in FIG. 2 in the horizontal direction, and can uniformly cool the mold M in the horizontal direction. The gas supply nozzles 22 blow (eject) the cooling gas CG toward the mold M from the respective discharge ends 221 that are distal ends facing the mold M. As the cooling gas CG blown toward the mold M from the gas supply nozzles 22, inert gas such as argon (Ar) and helium (He) is preferably used in order to suppress oxidation of the alloy A. Further, as the temperature of the cooling gas CG, about ambient temperature is sufficient. However, the cooling gas CG at a temperature lower than the ambient temperature may be used, in particular, in order to accelerate solidification.

Each of the actuators 23 advances and retreats the corresponding gas supply nozzle 22 so as to keep a distance between the discharge end 221 of the corresponding gas supply nozzle 22 and the mold M constant while avoiding interference between the gas supply nozzle 22 and the mold M. In other words, advancing and retreating of the gas supply nozzles 22 are performed depending on the width dimension of the mold M. The gas supply nozzles 22 are advanced with respect to a part of the mold M having a small width dimension, and are retreated with respect to a part of the mold M having a large width dimension. The actuators 23 are provided corresponding to the plurality of gas supply nozzles 22, and the gas supply nozzles 22 are independently advanced and retreated. Accordingly, even in a case of the mold M including a deformed planar shape, it is possible to keep a distance from each of the gas supply nozzles 22 to the mold M constant, or to adjust the distance to an appropriate distance.

Next, the radiation cooling portion 25 effects radiation cooling of the mold M. In this case, radiation indicates a phenomenon that energy is transferred from a high-temperature object to a low-temperature object. In a case of the casting device 1, the high-temperature object is the mold M and the low-temperature object is the radiation cooling portion 25.

The radiation cooling portion 25 includes a structure in which a cooling medium such as cooling water CW circulates through, for example, a path provided inside a cylindrical water-cooling jacket 26 that is made of copper, a copper alloy, aluminum, an aluminum alloy, or the like with high thermal conductivity. The radiation cooling portion 25 surrounds the mold M to perform radiation cooling of the high-temperature mold M that passes through a hollow part.

The radiation cooling portion 25 is adjacently provided directly below the gas supply nozzles 22 of the gas cooling portion 21, and the gas supply nozzles 22 and the radiation cooling portion 25 are arranged in series to one another in the vertical direction.

The driving rod 8 elevates and lowers the mold M via the cooling table 9.

As illustrated in FIG. 1 and FIG. 2, the driving rod 8 is provided so as to penetrate through a bottom wall 5B of the cooling chamber 5, and is elevated and lowered inside the cooling chamber 5 by an actuator (not illustrated) while supporting the cooling table 9.

As illustrated in FIG. 1 and FIG. 2, the cooling table 9 supports the mold M from below while closing the lower opening MB of the mold M, and cools the alloy A inside the mold M particularly through the lower opening MB.

[Operation]

Next, casting operation by the casting device 1 including the above-described configuration is described.

<Pouring Step>

As illustrated in FIG. 2, the driving rod 8 is moved to the highest position while the driving rod 8 supports the mold M through the cooling table 9, to place the mold M excluding a part of the lower end, inside the heating chamber 4. Thereafter, the alloy A melted in an unillustrated melting furnace is poured into the mold M from the upper opening MA of the mold M.

Since the heating chamber 4 is maintained at a temperature higher than the melting point of the alloy A, the alloy A in the molten state poured in the mold M is not solidified. On the other hand, the bottom of the poured alloy A in the mold M is solidified earlier by coming into contact with the cooling table 9, and a solidification interface that is a thin solidified part is formed.

In the pouring step, each of the discharge ends 221 of the respective gas supply nozzles 22 stands by at an advanced position that is closest to a center axis of the casting device 1. In the pouring step, the cooling gas CG may be discharged from the gas supply nozzles 22, or the cooling water CW may circulate through the water-cooling jacket 26.

<Cooling Step>

Figure 3:
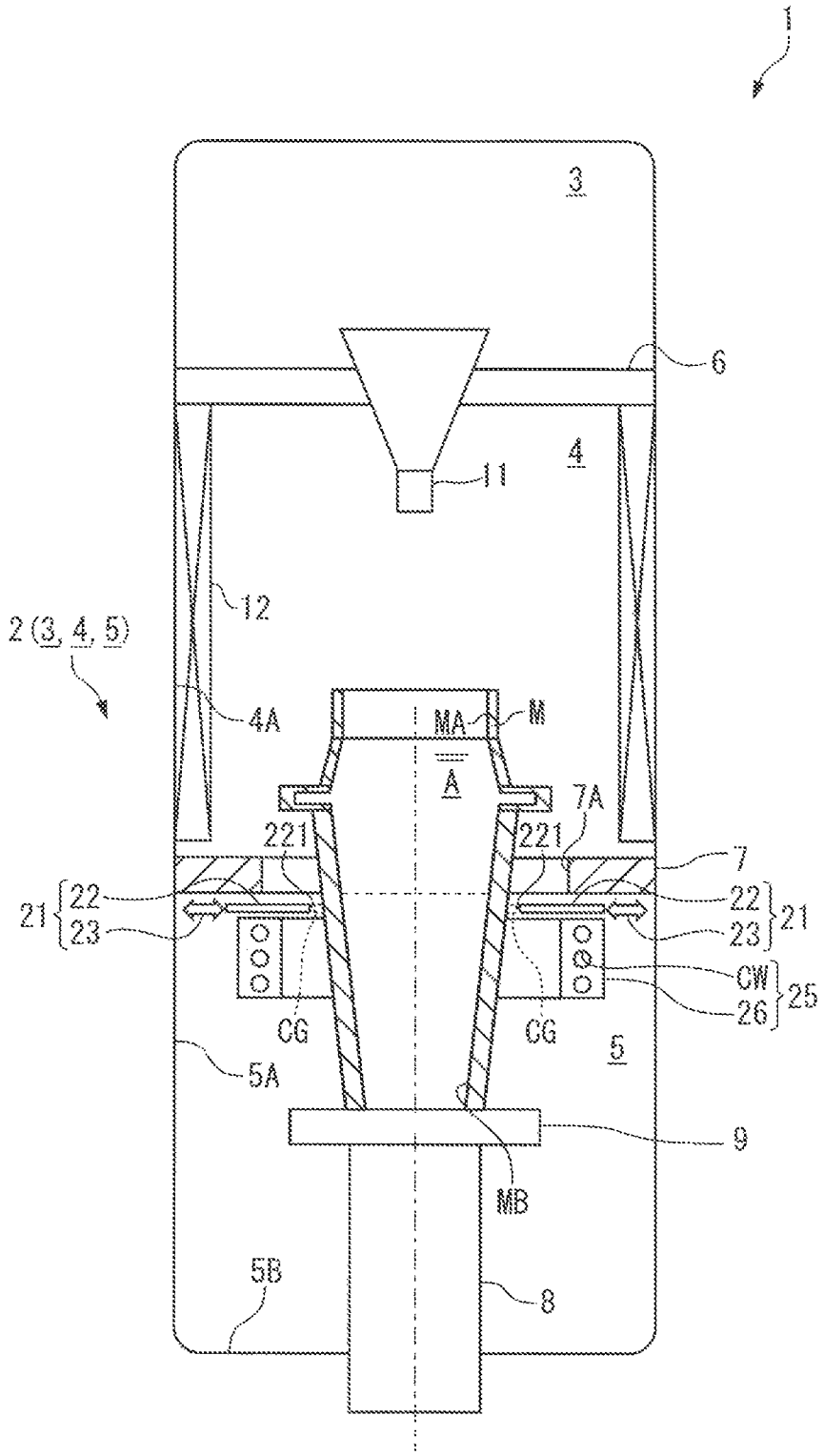
FIG. 3 is a diagram illustrating a state where movement of the mold is progressed from the state of FIG. 2.

After a necessary amount of alloy A is poured, the driving rod 8 is lowered to move the mold M into the cooling chamber 5 through the mold path 7A of the heat shielding body 7 at a slow speed as illustrated in FIG. 3. The moving speed of the mold M at this time is, for example, about several tens centimeters per one hour.

Since the inside of the cooling chamber 5 is maintained at the temperature lower than the melting point of the alloy A inside the mold M, the solidification interface is gradually moved upward according to the movement of the mold M into the cooling chamber 5, and directional solidification is accordingly effected.

The cooling gas CG is blown toward the mold M from the gas supply nozzles 22 and the cooling water CW circulates through the water-cooling jacket 26 while the mold M is lowered. This allows the cooling mechanism 20 to cool the mold M directly below the heat shielding body 7. The actuators 23 are operated in conjunction with the lowering operation of the driving rod 8 to retreat the gas supply nozzles 22. As a result, the distance from each of the gas supply nozzles 22 to the mold M is kept constant.

Figure 4:
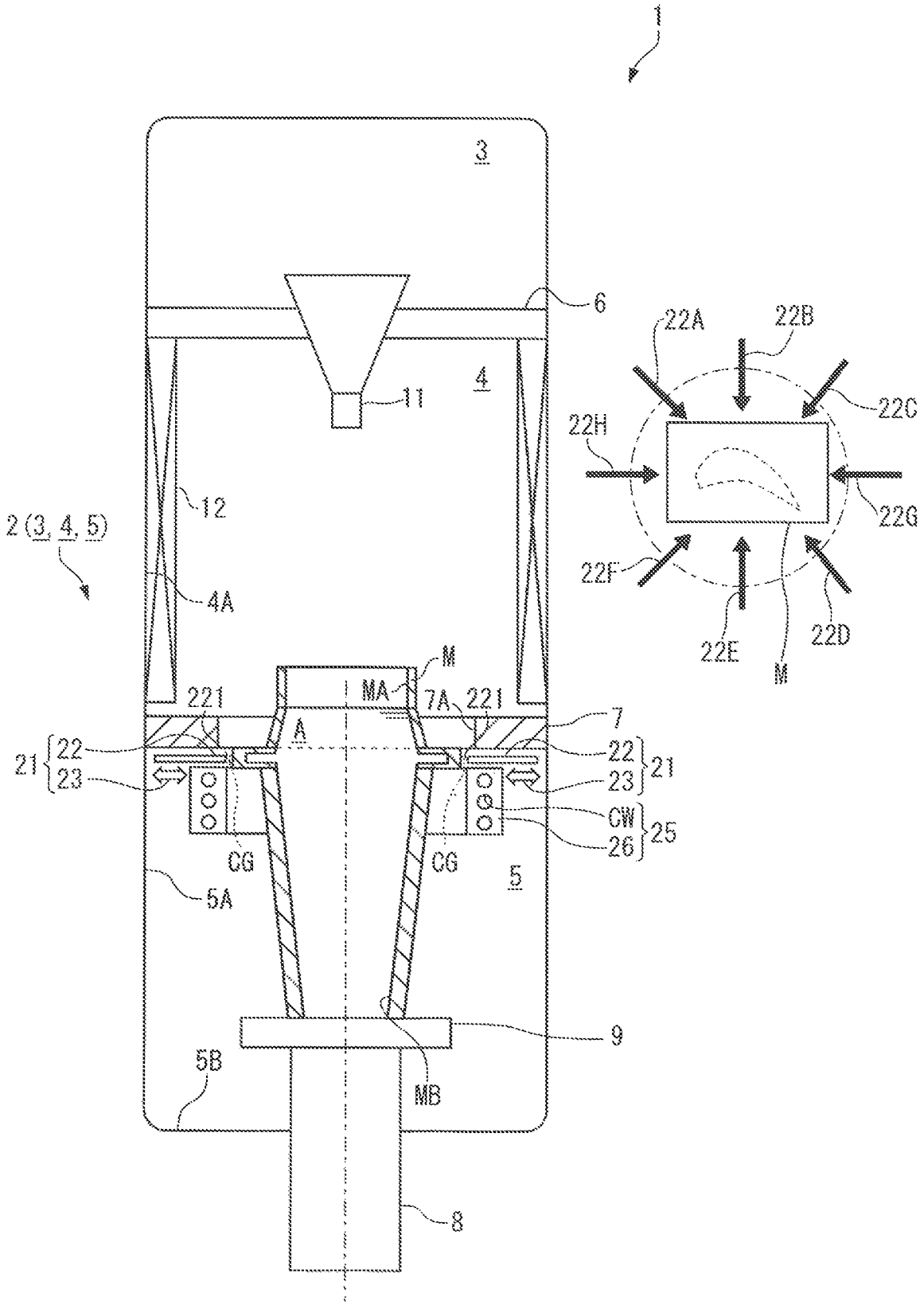
FIG. 4 is a diagram illustrating a state where the movement of the mold is further progressed from the state of FIG. 3.

During the process of lowering the mold M, the gas supply nozzles 22 each reach the most retreated position when the part of the mold M including the largest width dimension passes through the mold path 7A of the heat shielding body 7, as illustrated in FIG. 4. The distance from each of the gas supply nozzles 22 to the mold M is kept constant also at the most retreated position.

After the mold M is lowered in position at a slow speed, the cooling step ends. Thereafter, the mold M is taken out from the cooling chamber 5 and is dismantled to obtain a directionally-solidified casting.

[Effects]

The casting device 1 according to the present embodiment achieves the following effects.

In the casting device 1, the cooling gas CG is blown from the gas supply nozzles 22 to perform cooling and the radiation cooling is effected by the radiation cooling portion 25 in association with lowering of the mold M in the cooling chamber 5. As a result, cooling is effected on the mold M from the lower end toward the upper end. Therefore, according to the present embodiment, the directional solidification is performable while improving the temperature gradient and the solidification speed by increasing the speed to cool the mold M. This makes it possible to manufacture a casting increased in mechanical strength, while suppressing casting defect.

In particular, in the present embodiment, the gas supply nozzles 22 that are advanceable and retreatable are used to perform cooling while the distance between each of the discharge ends 221 of the respective gas supply nozzles 22 and the mold M is kept constant. Accordingly, it is possible to constantly maintain high cooling performance even for molds M that have different width dimensions.

At this time, in place of advancing and retreating of the gas supply nozzles 22, a supply amount of the cooling gas CG may be increased and decreased. In this case, however, a large amount of cooling gas CG is necessary. In contrast, in the present embodiment, the supply of cooling gas CG can be suppressed at a certain minimum amount, which makes it possible to suppress a manufacturing cost of a casting. In addition, the mechanism to advance and retreat the gas supply nozzles 22 is advantageously simple. However, it is not intended to eliminate the increase and decrease of the supply amount of cooling gas CG in addition to the present invention.

In the casting device 1, the gas cooling portion 21 and the radiation cooling portion 25 constituting the cooling mechanism 20 are arranged in series to each other in the vertical direction. Therefore, they can fully exert cooling performance without inhibiting cooling functions each other. In addition, since the radiation cooling portion 25 allows the radiation cooling to be acted also on the gas supply nozzles 22 and the cooling gas CG that is discharged, the cooling effect on the mold M is maximized by the gas cooling portion 21.

In particular, in the cooling mechanism 20, the gas cooling portion 21 and the radiation cooling portion 25 are disposed in order from above. The mold M that is being lowered is cooled by the cooling gas CG blown from the gas supply nozzles 22, and is then subjected to the radiation cooling by the radiation cooling portion 25. Therefore, according to the present embodiment, as compared with a case where the arrangement of the gas cooling portion 21 and the radiation cooling portion 25 is inverse in the vertical direction, the cooling gas CG is supplied to a region immediately next to the heating chamber 4 in which the temperature of the mold M itself is high. This makes it possible to maximize the cooling performance by the gas cooling portion 21.

Although the preferred embodiment of the present invention has been described above, the configurations described in the above-described embodiment may be selected or appropriately modified without departing from the scope of the present invention.

Figure 5A:
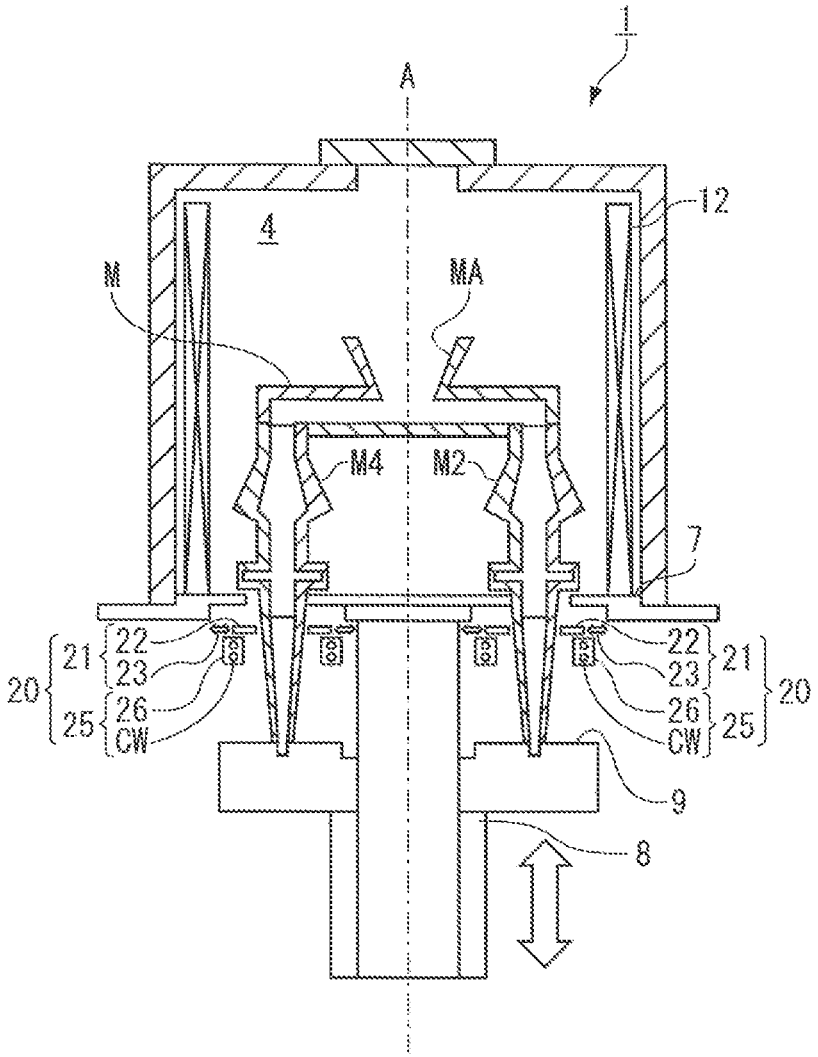
FIGS. 5A and 5B are diagrams each illustrating an example in which a plurality of castings are cast by a plurality of molds at the same time, FIG. 5A being a cross-sectional view illustrating a schematic configuration of a casting device, and FIG. 5B being a plane cross-sectional view illustrating a mold part.
Figure 5B:
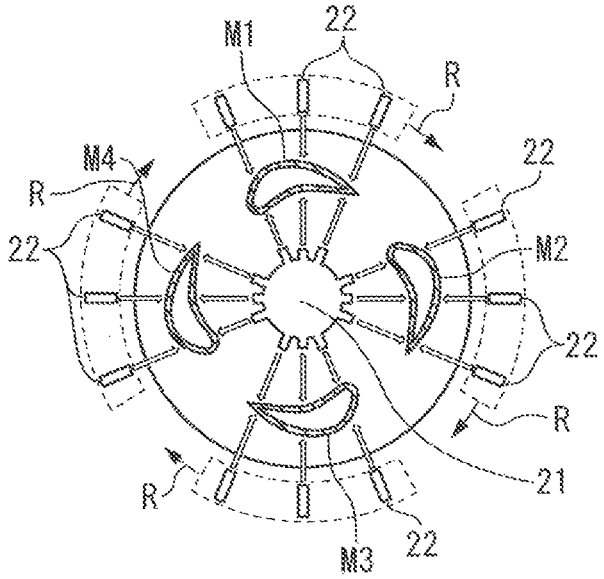

For example, as illustrated in FIGS. 5A and 5B, the present invention is suitably applicable to the casting device 1 that effects the directional solidification of the molten metal supplied in a plurality of molds M (M1, M2, M3, and M4) disposed around a predetermined region by moving the plurality of molds M from the heating chamber 4, and includes the driving rod 8 moving the plurality of molds M (M1, M2, M3, and M4) from the heating chamber 4, the radiation cooling portion 25 cooling, by the cooling gas, the plurality of molds M (M1, M2, M3, and M4) from inside of the predetermined region, and the gas cooling portion 21 cooling, by blowing the cooling gas from the gas supply nozzles 22, the plurality of molds M (M1, M2, M3, and M4) from outside of the predetermined region.

In the case of the casting device 1, the gas supply nozzles 22 may be advanced or retreated as illustrated in FIG. 5A. Alternatively, as illustrated in FIG. 5B, rotation R of the gas supply nozzles 22 may be performed to move, for example, the positions of the respective discharge ends to positions not interfering the molds M (M1, M2, M3, and M4).

Figure 6A:
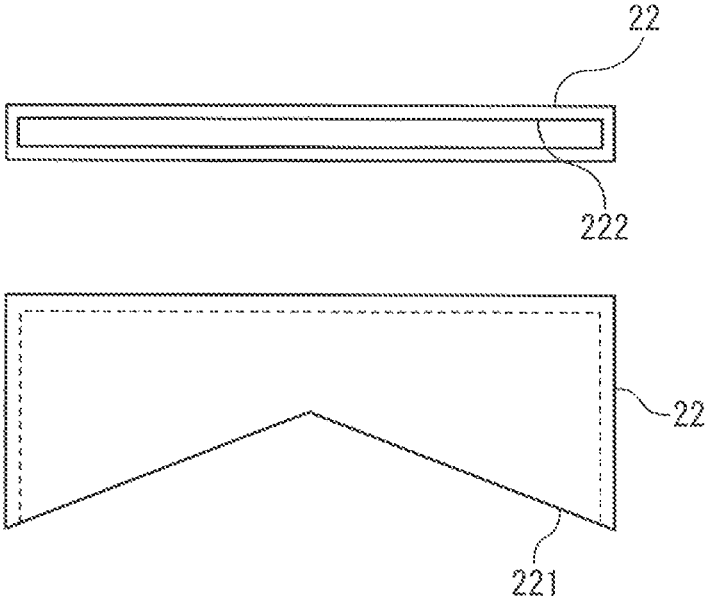
FIGS. 6A and 6B are diagrams each illustrating a nozzle that discharges cooling gas used in the present embodiment, FIG. 6A being a front view and a plan view, and FIG. 6B being a plan view illustrating a use state.
Figure 6B:
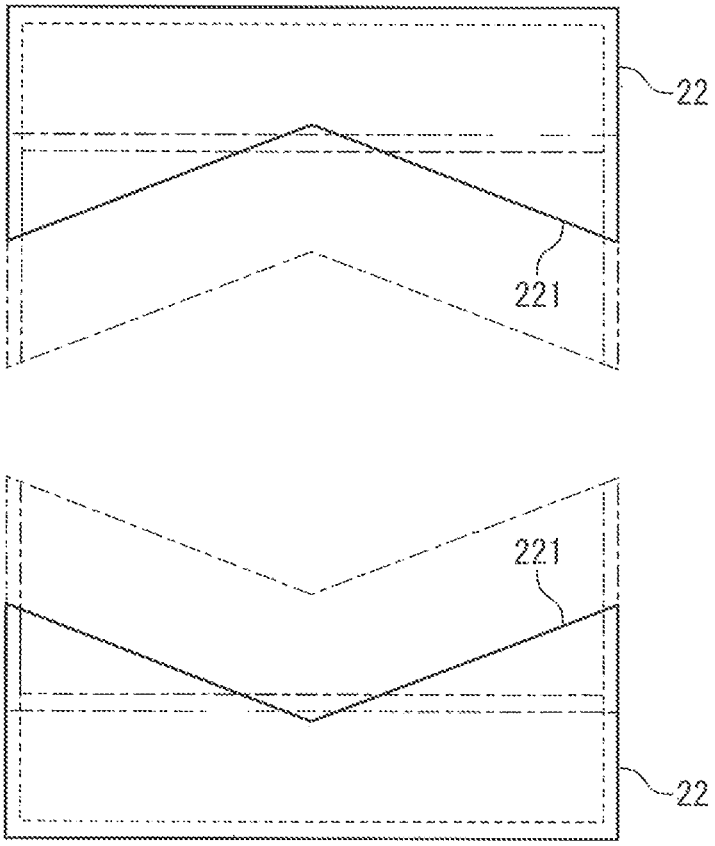

Further, the gas cooling portion 21 includes the plurality of independent gas supply nozzles 22. Alternatively, as illustrated in FIG. 6A, the gas supply nozzles 22 each including a slit-like nozzle opening 222 that extends in the width direction, namely, in the horizontal direction may be used. The discharge end 221 of each of the gas supply nozzles 22 is formed in a V-shape, and the paired gas supply nozzles 22 are used such that both of the discharge ends 221 face the mold M as illustrated in FIG. 6B. Although not illustrated, the gas supply nozzles 22 are also advanced or retreated by the respective actuators 23.

When the gas supply nozzles 22 each including the slit-like nozzle opening 222 are used, discharge flow velocity of the cooling gas CG becomes uniform, which makes it possible to uniformly cool the surface of the mold M.

Figure 7A:
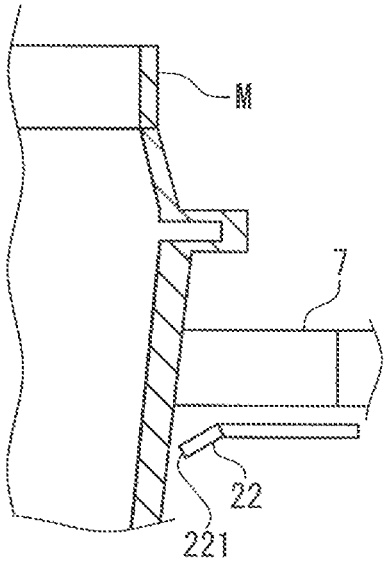
FIGS. 7A and 7B are diagrams each illustrating a modification of the nozzle that discharges the cooling gas used in the present embodiment.

Further, the above-described gas supply nozzles 22 correspond to an example in which the cooling gas CG is discharged in the horizontal direction; however, the present invention is not limited thereto. For example, as illustrated in FIG. 7A, the gas supply nozzles 22 that each include the distal end directed downward opposite to the heating chamber 4 are preferably used. This makes it possible to reduce a flow rate of the cooling gas CG unnecessarily flowing into the heating chamber 4, and to accordingly reduce the output of the heater 12.

Figure 7B:
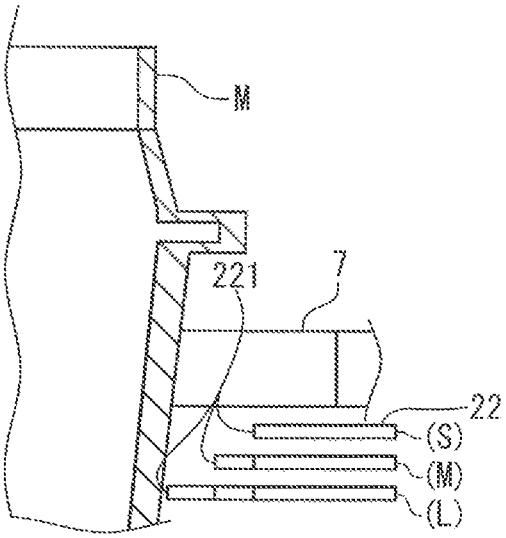

Further, the above-described gas cooling portion 21 can keep the distance between each of the gas supply nozzles 22 and the mold M constant or can adjust the distance to an appropriate distance by advancing or retreating the gas supply nozzles 22. The present invention, however, is not limited thereto. As illustrated in FIG. 7B, the gas supply nozzles 22 are expanded or contracted at fixed positions to keep the distance between each of the discharge ends 221 that are distal ends discharging the cooling gas CG and the mold M constant, or to adjust the distance to an appropriate distance. This may reduce the region occupied by the gas supply nozzles 22 as compared with the case where the actuators 23 are provided for the respective gas supply nozzles 22. Note that FIG. 7B individually illustrates the gas supply nozzle 22 including a short size S, the gas supply nozzle 22 including a middle size M, and the gas supply nozzle 22 including a long size L; however, one gas supply nozzle 22 is actually expanded or contracted at one fixed position. Further, in this example, the sizes S, M, and L are illustrated; however, the gas supply nozzle 22 that is steplessly expanded or contracted is preferably used.

Further, in the above-described embodiment, each of the gas supply nozzles 22 is advanced and retreated; however, movement of the gas supply nozzles 22 according to the present invention is not limited thereto. For example, the gas supply nozzles 22 may be parallelly moved in the horizontal direction as a group. More specifically, as illustrated in FIGS. 8A-8D, gas supply nozzles 22A, 22B, 22C, 22D, 22E, and 22F may be parallelly moved leftward in the figure as a group, and gas supply nozzles 22G and 22H may be parallelly moved downward in the figure as a group.

Further, each of the plurality of gas supply nozzles 22 may be rotated in the horizontal direction. More specifically, as illustrated in FIGS. 8C and 8D, the gas supply nozzles 22A to 22H are rotated to increase or decrease a region surrounded by the gas supply nozzles 22A to 22H.

Movement of the gas supply nozzles 22 is not limited to the movement exemplified in FIGS. 8A-8D. For example, in FIGS. 8A and 8B, the plurality of gas supply nozzles 22A to 22H are parallelly moved by a group unit; however, the plurality of gas supply nozzles 22 may be rotationally moved by a group unit.

Further, as a mode of the movement, the gas supply nozzles 22 may be moved in the vertical direction without being limited to the movement in the horizontal direction. For example, a rotation axis may be set in the horizontal direction, and the gas supply nozzles 22 may be swung around the rotation axis.

Moreover, in the present invention, means to control the movement of the gas supply nozzles 22 are optional. For example, data relating to the dimensions and the shape of the mold M used in the casting is held, and the advanced and retreated positions of the gas supply nozzles 22 may be adjusted based on the data. Alternatively, a range sensor that measures the distance from each of the discharge ends 221 of the respective gas supply nozzles 22 to the surface of the mold M may be provided, and the advanced and retreated positions of the gas supply nozzles 22 may be adjusted based on the distance to the surface of the mold M measured by the range sensor.

REFERENCE SIGNS LIST

1 Casting device
2 Vacuum chamber
3 Pouring chamber
4 Heating chamber
4A Inner wall surface
5 Cooling chamber
5A Inner wall surface
6 Heat shielding body
7 Heat shielding body
7A Mold path
8 Driving rod
9 Cooling table
11 Pouring nozzle
12 Heater
20 Cooling mechanism
21 Gas cooling portion
22, 22A, 22B, 22C, 22D, 22E, 22F, 22G Gas supply nozzle
221 Discharge end
222 Nozzle opening
23 Actuator
25 Radiation cooling portion
26 Water-cooling jacket
CG Cooling gas
CW Cooling water
M Mold
MA Upper opening
MB Lower opening

The invention claimed is:

1. A casting device, comprising:
a movable mold;
a heating chamber in which a molten metal is to be poured into the mold; and
a cooling chamber adjacent to the heating chamber, the mold being movable from the heating chamber to the cooling chamber to be cooled,
wherein the cooling chamber includes a gas cooling portion including a gas supply nozzle configured to discharge cooling gas toward the mold from a discharge end of the gas supply nozzle, and
wherein the gas cooling portion is configured to adjust a position of the discharge end of the gas supply nozzle in response to movement of the mold.

2. The casting device according to claim 1, wherein the gas cooling portion is configured to move the gas supply nozzle to adjust the position of the discharge end.

3. The casting device according to claim 1, wherein the gas cooling portion is configured to advance or retreat the gas supply nozzle to adjust the position of the discharge end.

4. The casting device according to claim 1, wherein the gas cooling portion is configured to expand or contract the gas supply nozzle at fixed positions to adjust the position of the discharge end.

5. The casting device according to claim 1, wherein
the gas supply nozzle is one of a plurality of gas supply nozzles of the gas cooling portion, and
the plurality of gas supply nozzles are radially arranged in a horizontal plane to surround the mold.

6. The casting device according to claim 1, wherein the gas supply nozzle includes a slit-shaped nozzle opening extending in a horizontal direction.

7. The casting device according to claim 1, wherein the cooling chamber is below the adjacent heating chamber in a vertical direction, and gas supply nozzle is configured such that the discharge end of the gas supply nozzle is directed downward.

8. The casting device according to claim 1, wherein the cooling chamber is below the adjacent heating chamber in a vertical direction, and the cooling chamber includes a radiation cooling portion below the gas cooling portion in the vertical direction.

9. The casting device according to claim 8, wherein the radiation cooling portion includes a cylindrical water-cooling jacket.

10. The casting device according to claim 1, wherein
the mold is one of a plurality of molds,
the gas supply nozzle is one of a plurality of gas supply nozzles of the gas cooling portion, and
the gas cooling portion is configured to adjust a discharge end of each of the plurality of gas supply nozzles associated with each respective one of the plurality of molds in response to movement of the each respective one of the plurality of molds.

11. The casting device according to claim 10, wherein the plurality of gas supply nozzles are rotated in a horizontal plane to adjust the position of the discharge end of each of the gas supply nozzles.

12. The casting device according to claim 1, wherein the gas cooling portion is configured to adjust the position of the discharge end of the gas supply nozzle in response to movement of the mold such that a distance between the discharge end of the gas supply nozzle and the mold is kept constant.

13. The casting device according to claim 1, wherein the gas cooling portion further includes an actuator configured to advance and retreat the gas supply nozzle such that a distance between the discharge end of the gas supply nozzle and the mold is kept constant.

14. A casting method comprising:
pouring a molten metal into a mold; and
cooling the mold from one direction,
wherein, during the cooling, a discharge position of cooling gas is adjusted in response to movement of the mold while the cooling gas is discharged toward the mold.

15. The casting method according to claim 14, wherein, during the cooling, the discharge position of cooling gas is adjusted in response to movement of the mold while the cooling gas is discharged from a discharge end of a gas supply nozzle toward the mold such that the distance between the discharge end of the gas supply nozzle and the mold is kept constant.

16. The casting method according to claim 15, wherein the distance between the discharge end of the gas supply nozzle and the mold is kept constant by advancing and retreating the gas supply nozzle using an actuator.

* * * * *